United States Patent [19]

Nelson

[11] Patent Number: 5,061,920

[45] Date of Patent: Oct. 29, 1991

[54] SATURATING COLUMN DRIVER FOR GREY SCALE LCD

[75] Inventor: Larry A. Nelson, Albuquerque, N. Mex.

[73] Assignee: Honeywell Inc., Minneapolis, Minn.

[21] Appl. No.: 656,128

[22] Filed: Feb. 14, 1991

Related U.S. Application Data

[63] Continuation of Ser. No. 287,002, Dec. 20, 1988, abandoned.

[51] Int. Cl.[5] ..... G09G 3/36

[52] U.S. Cl. ..... 340/784; 340/793; 340/811

[58] Field of Search ..... 340/718, 719, 767, 793, 340/765, 784, 811; 358/32, 236, 230

[56] References Cited

U.S. PATENT DOCUMENTS

| | | | |
|---|---|---|---|
| 4,217,574 | 8/1980 | Anderson | 358/32 |
| 4,571,584 | 2/1986 | Suzuki | 340/784 |
| 4,859,998 | 8/1989 | Kawamura et al. | 340/784 |

OTHER PUBLICATIONS

"Thin-Film Transistors for Video Applications", by Thomash, Credelle 1988, International Display Research Conference, IEEE, 1988, pp. 208-214.

"Peripheral Circuit Integrated Poly-Si TFTLCD with Gray Scale Representation", by Ohwada et al., 1988 International Display Research Conference, IEEE, 1988, pp. 215-219.

*Primary Examiner*—Jeffery A. Brier

*Attorney, Agent, or Firm*—Leone & Moffa

[57] ABSTRACT

A saturating column driver for an LCD substrate. Digital data is entered into a register in a serial fashion to produce a series of single-column addresses. The single-column addresses are latched and apparatus is provided for translating video binary words into grey scale codes. Also provided are switches responsive to the translated video binary words which switch a voltage input corresponding to the video binary word through to the LCD substrate to generate the desired grey scale.

20 Claims, 5 Drawing Sheets

+V
BUFFER
INVERTER
566
50
$V_{16}$
EXT. GEN.
516
565
50
$V_{15}$
515
564
50
$V_{14}$
514
563
50
$V_{13}$
513
562
50
$V_{12}$
512
552
50
$V_2$
502
551
50
$V_1$
501

SATURATING COLUMN DRIVER FOR GREY SCALE LCD

This is a continuation of copending application Ser. No. 07/287,002, filed on Dec. 20, 1988 now abandoned.

BACKGROUND OF THE INVENTION

I. Field of the Invention

The invention applies to video signal interface apparatus, and more particularly to apparatus which provides a means of driving the column of an LCD active matrix with a variable voltage to produce grey scale but with only drivers which operate in a saturated mode.

II. Discussion of the Prior Art

State-of-the-art analog column drivers used in active matrix LCD grey scale applications dissipate power at a high rate. This high power dissipation limits the temperature operating range of the active matrix, reduces reliability and limits maximum panel size and pixel density.

FIG. 1 shows a conventional grey scale liquid crystal display (LCD) column drive circuit in block diagram form. In such conventional circuits, a logical "1" is entered into a shift register 10 and propagated therein to produce one single-column address at a time. This is done sequentially until all columns have been addressed. Each time a column is addressed, the appropriate switch S is activated and a sample-and-hold capacitor C1A, for example, is selected to store the video voltage. During this setup, capacitor C1B which was accessed one line earlier by input switch B1 is providing the video voltage for that column for the particular row currently being output through output switch A2 and an analog line driver 20 to the display. There are several variations on this theme, such as using a digital-to-analog converter (DAC) to store voltages instead of a capacitor in a keyed sample-and-hold circuit as described above. Such circuits require high power consumption and are very complex in comparison to the invention. Such complexity and high power consumption might be warranted if a larger number of grey levels were available. However, a typical LCD display is limited by construction and viewing angle variation to a small number of grey shades. For the example shown, 16 grey shades are used. In such cases, the extra power and increased complexity of more capable column drivers is not warranted.

SUMMARY OF THE INVENTION

A grey scale column driver which uses devices operated only in a saturated mode for an LCD substrate is disclosed. The saturating column driver comprises register means for entering digital data to produce a column voltage address; means for latching the column voltage address connected to the register means; means for voltage level translating the column voltage address connected to the latching means; and means for different column voltages switching responsive to the column voltage address connected to the translating means. A plurality of voltage generator means for generating a plurality of electronic signals is connected to the switching means so that when the switching means is activated, at least one of the voltage generator means supplies an electronic signal through the switching means to drive the column of the LCD substrate.

It is one object of the invention to decrease power in active matrix LCD column drivers by taking advantage of the finite capability of an LCD to present grey scale without viewing angle difficulties.

Other features objects and advantages of the invention will become apparent to one skilled in the art through the drawings herein wherein like reference numerals refer to like elements, and the detailed description of the preferred embodiment and claims herein.

DETAILED DESCRIPTION OF THE PREFERRED EMBODIMENT

The invention will be discussed herein with reference to an illustrative embodiment. Those skilled in the art will recognize that many alternative embodiments can be accomplished using the teachings of this invention and that the invention is not limited to the embodiment illustrated for explanatory purposes.

Figure 2:
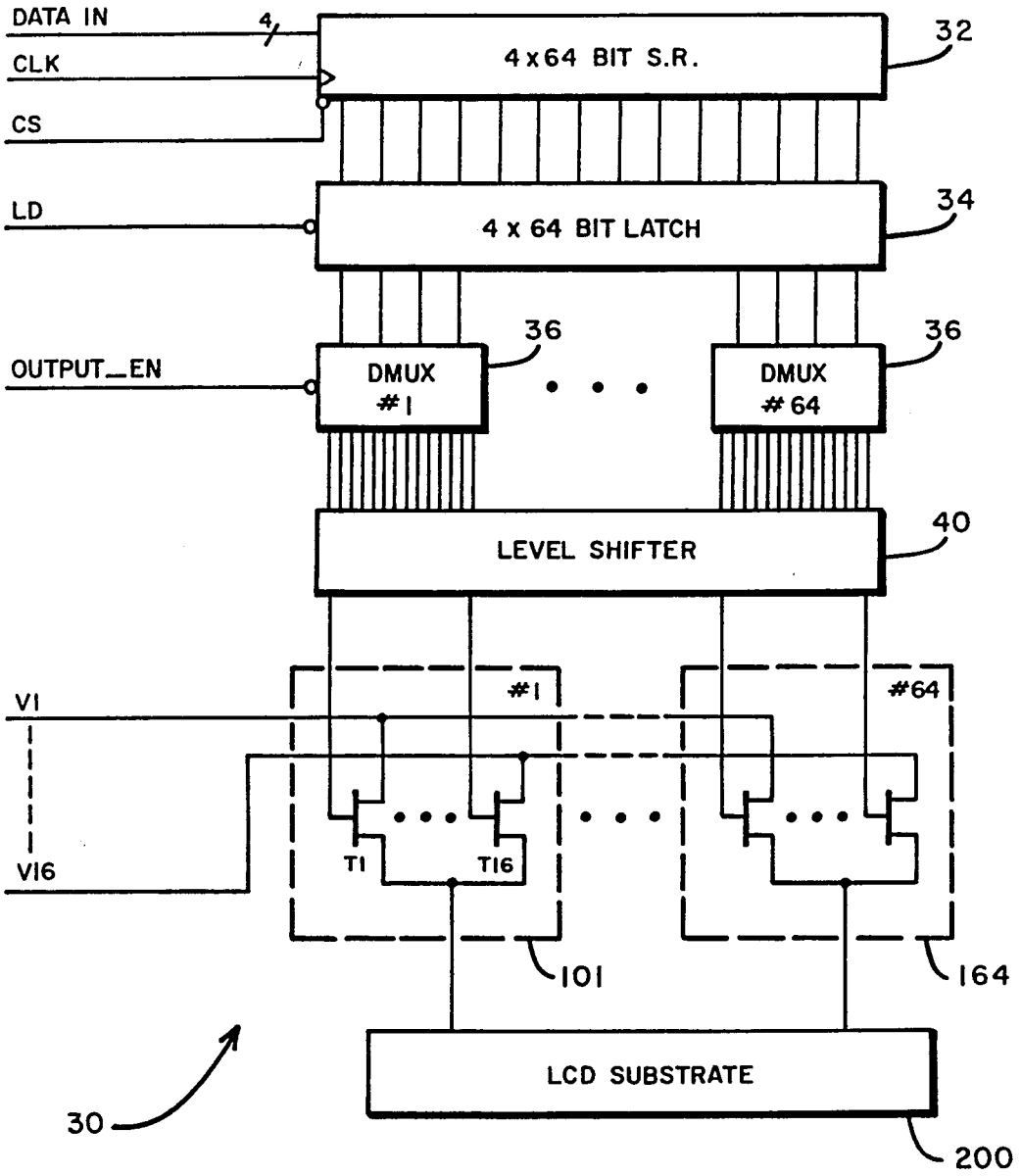
FIG. 2 is a functional block diagram of the LCD column driver of the invention.

FIG. 2 shows a functional block diagram of one embodiment of the LCD column driver of the invention. LCD column driver 30 comprises a shift register 32 connected to a latch, or flip-flop 34 which is in turn connected to a series of demultiplexers 36. The plurality of demultiplexers 36 are in turn connected to level shifter 40 which controls a plurality of output drivers 101 through 164 in this example. As shown in FIG. 2, and as is well understood in the art, the level shifter 40 shifts the voltage levels received from the demultiplexers from a logical level to a switching level sufficient to control the output drivers. The output drivers may advantageously be comprised of transistors, for example, FETS appropriately sized to switch the voltages through to the LCD substrate. Lines V1 to V16 are connected to linear amplifiers 101 through 164 wherein each of the lines V1 through V16 represent a different video level. These 16 drives are located external to the LCD glass, thus their power dissipation does not have a significant effect on the reliability and environmental range of the LCD display as is the case in prior art systems. The video lines V1 to V16 are small in number compared to the number of columns in a typical LCD display.

Figure 4:
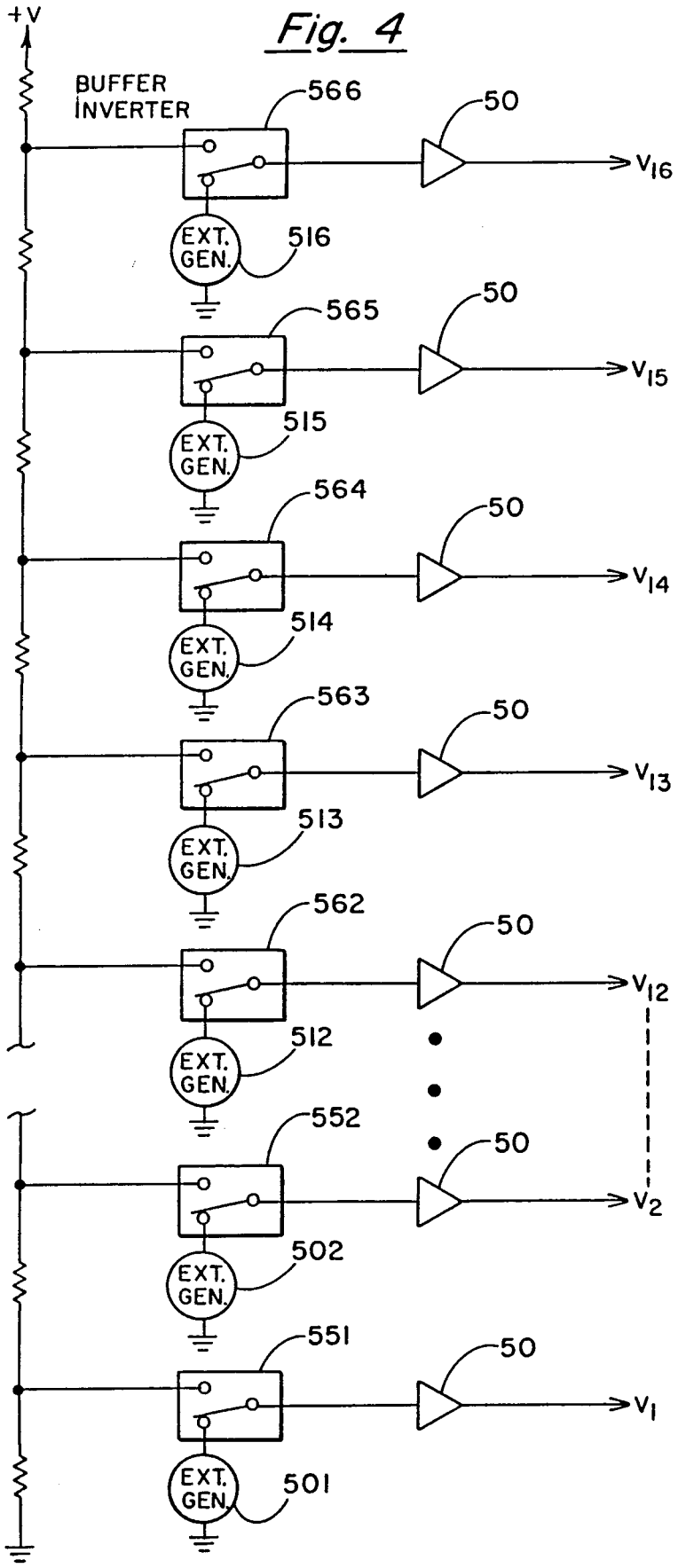
FIG. 4 shows one example of an application of the invention using an external signal generator in connection with the saturated column drivers of the invention.
Figure 2:
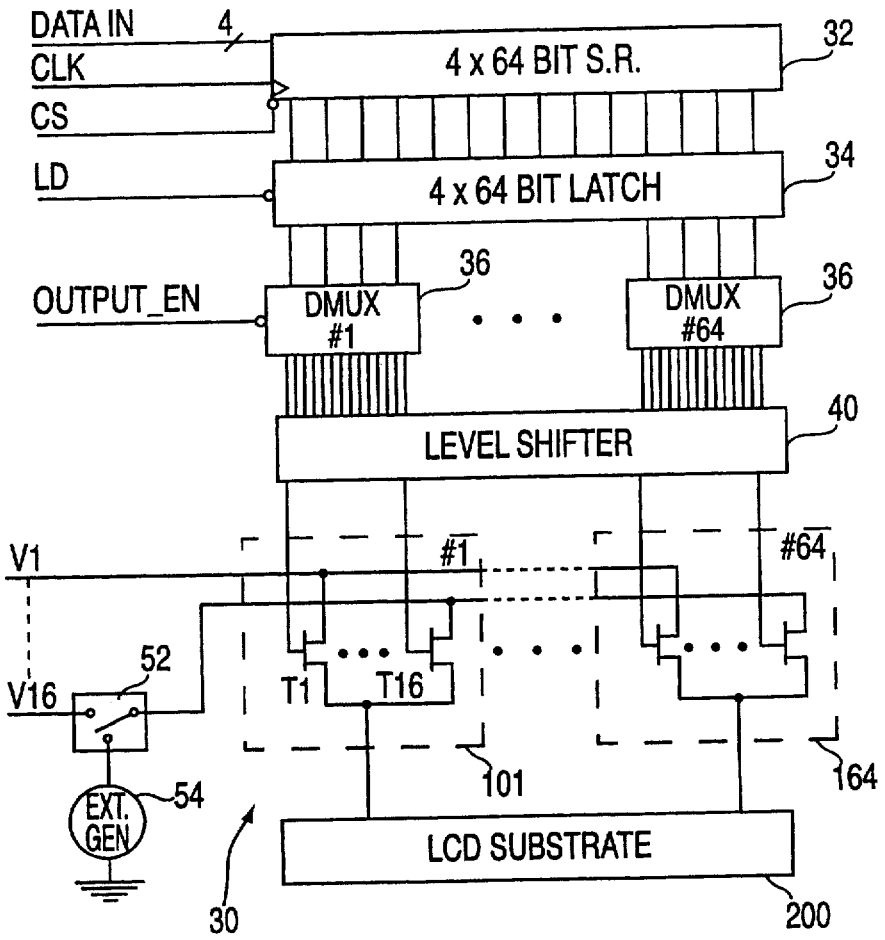

An external voltage generator 54, FIG. 4 generates voltages V1 through V16. This may be, for example, a simple voltage divider string connected to a reference supply as shown in FIG. 4. The buffer inverters 50 as shown in FIG. 4 provide a low impedance, sign reversible, drive to the LCD substrate 200 as shown in FIG. 2. Referring again to FIG. 4, a switch 52 may be included in the system so that an external signal can be injected directly to any column. Note that the external generator 54 and switch 52 may be located on any of the plurality of video signals V1 through V16. Those skilled in the art will also recognize that any number of video signals may be thus supplied to produce varying levels of grey scale. Notice that in FIG. 4 the system proposed uses analog video transmission which is digitized to provide addresses for switching FET transistors. Various other methods could be used to directly transmit digitized video to produce those same addresses. Further, notice that the video signals V1 through V16 may be distributed equally or unequally in various increments depending on the application. DC levels can be designed dynamically to match the signal from a TV camera, which has significant $\gamma$ for example. For test purposes a linear voltage distribution may be desirable.

Referring again to the external generator setup of FIG. 4, those skilled in the art will recognize that this configuration will allow injection of test signals into the LCD. These signals could be located anywhere on the line and would allow the user to inject clean signals which could be used, for example, for test purposes to detect bad pixels. Each voltage supply line V1, V2–V16, is optionally configured to receive voltage from either the resistor network or a set of external generators 501–516 switched through set of switches 551–566. The objective of the external generators is to provide an optional reference signal to each voltage level. In an alternative embodiment of the invention, the voltage sent to the LCD can be either a combination of the driver voltages or the external generator voltages.

Figure 1:
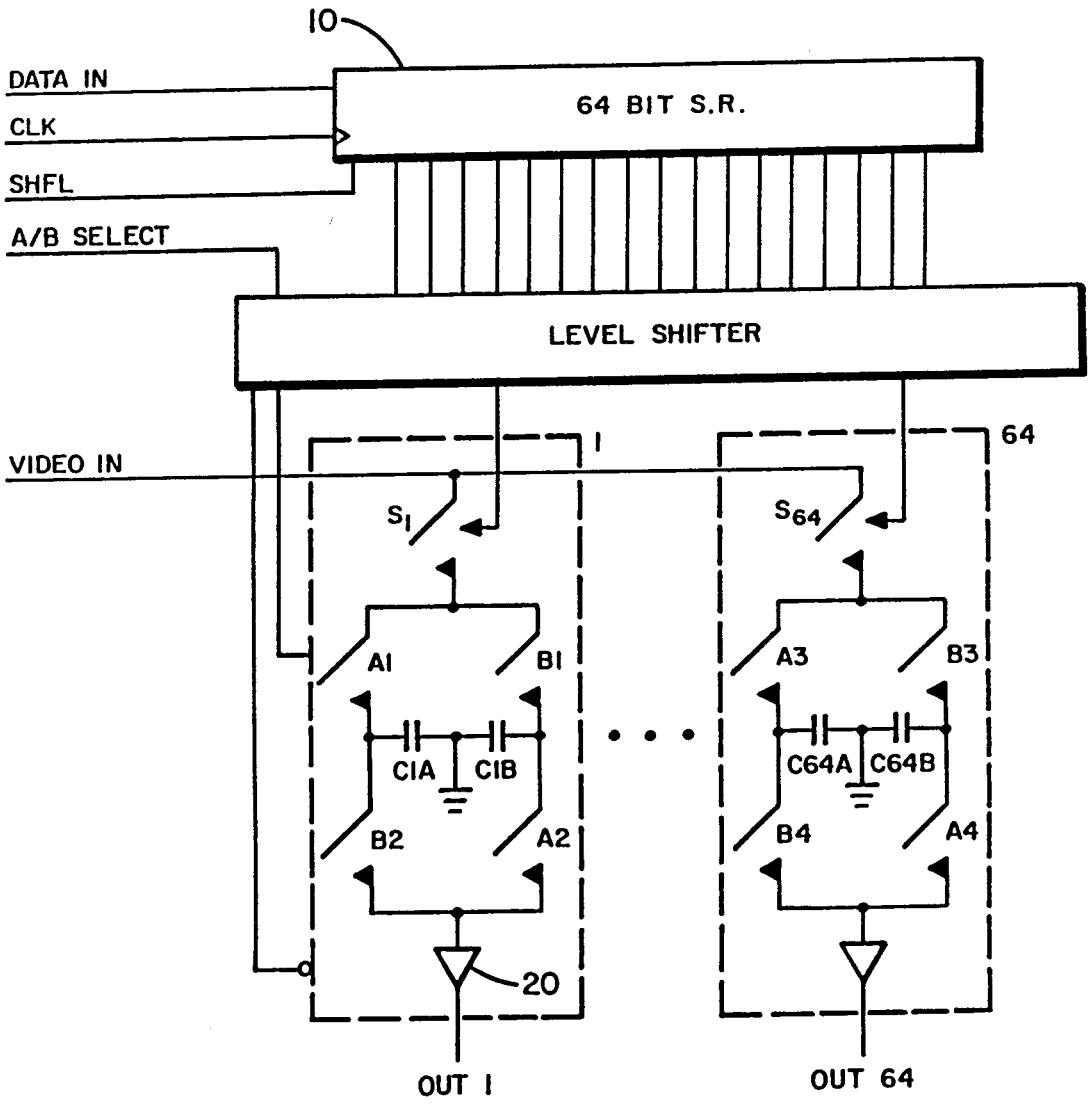
Fig. 1 PRIOR ART
FIG. 1 shows a conventional LCD analog column driver circuit in schematic form.
Figure 3:
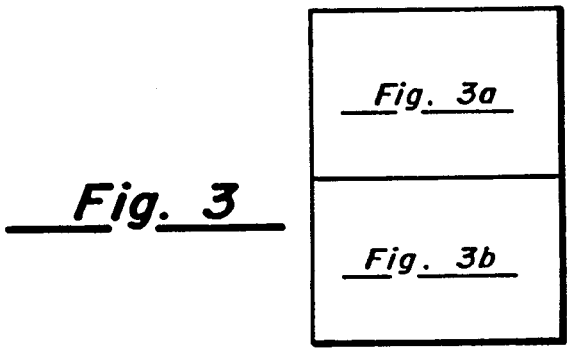
FIGS. 3, 3*a* and 3*b* show a video interface block diagram incorporating the grey shade voltage generator of the invention.
Figure 3A:
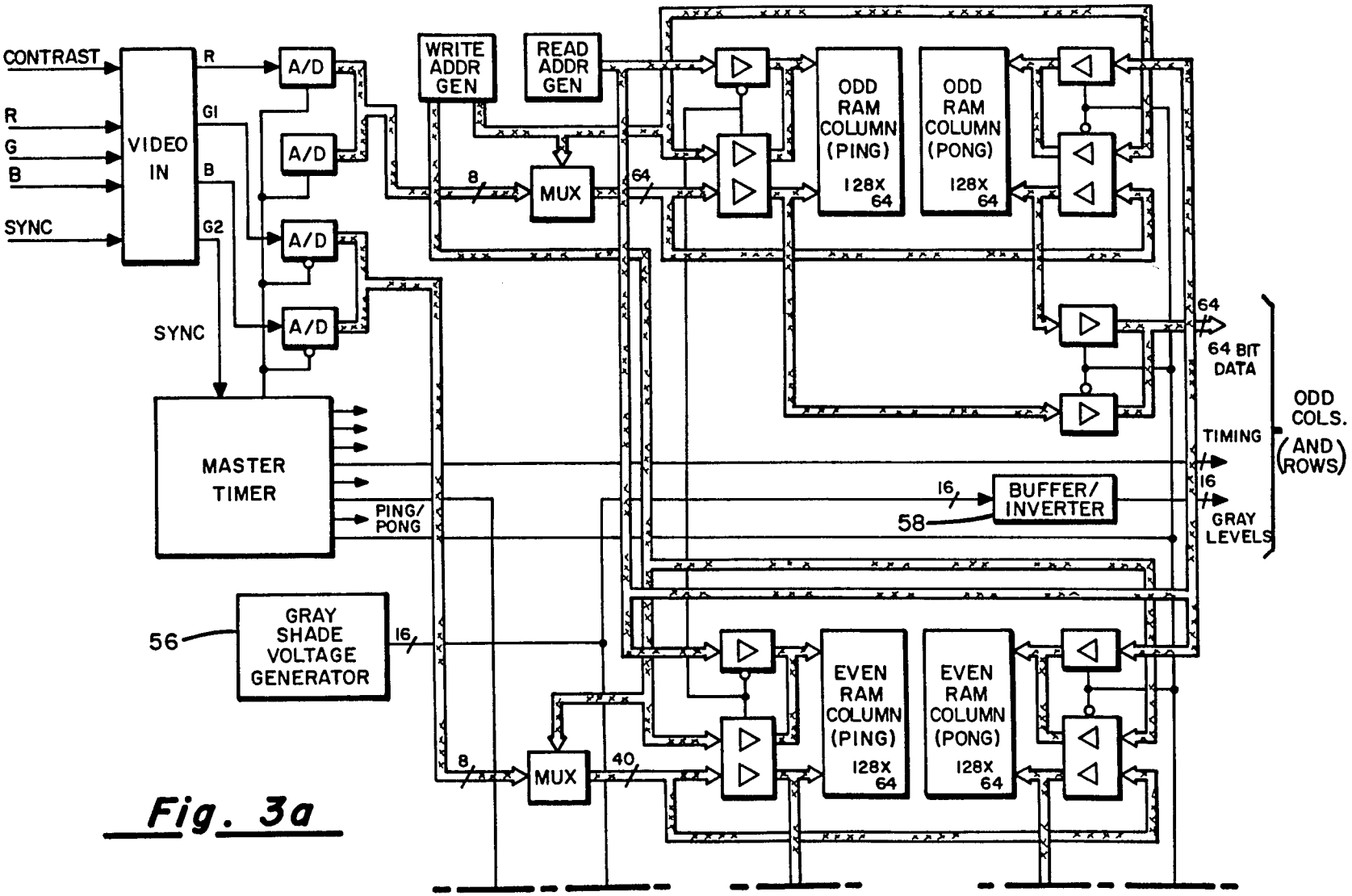
Figure 3B:
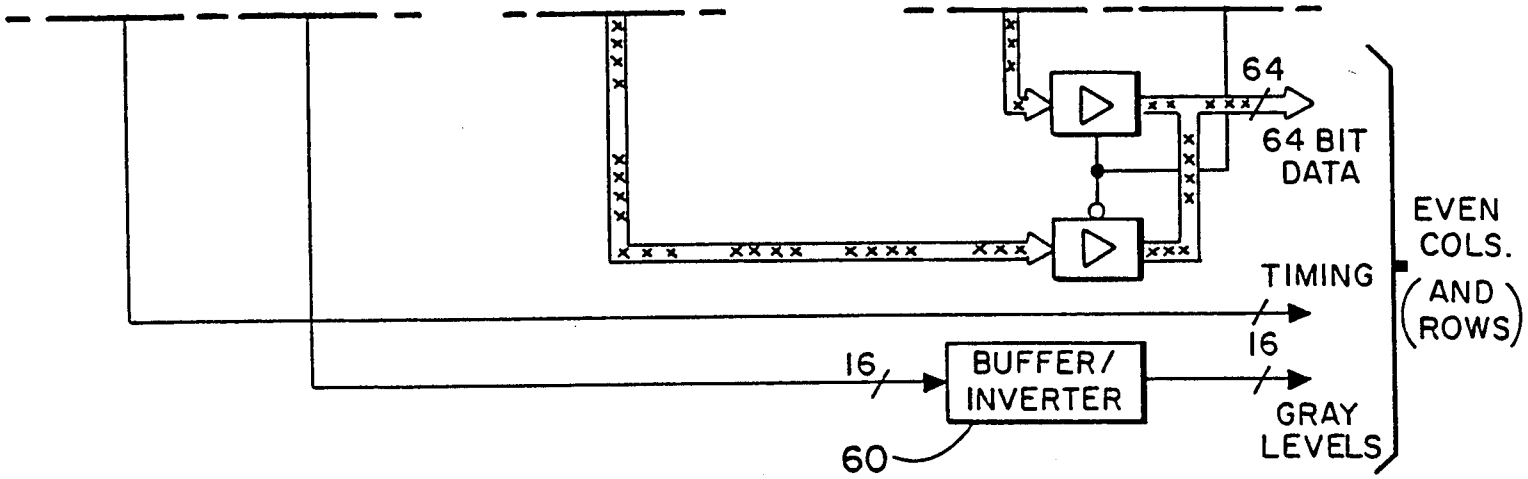

Referring now to FIGS. 3, 3*a* and 3*b* a video interface block diagram is shown incorporating one embodiment of the invention. The grey shade voltage generator 56 is connected to buffer inverters 58 and 60 which output the grey levels V1 through V16 Note that in the application shown in FIG. 3, an odd/even "ping pong" scheme is used. Except for the addition of the apparatus of the invention, such systems are well known in the art.

Having explained the physical embodiment of the invention, the operation of the invention will now be explained in detail with reference to the illustrative embodiment of FIG. 2. In operation, data is clocked into shift register 32 in serial fashion. Shift register 32 may advantageously be a 4×64 BIT device. The shift register 32 then produces one singlecolumn address at a time until all 64 columns have been addressed. This data is then latched as appropriate and passed through latch 34 to a plurality of demultiplexers 36. Those skilled in the art will appreciate that the latch could be a flip-flop. The demultiplexers 36 operate on the data in 4 bit video binary words and decode the video binary words into grey scale codes. In the example shown, the demultiplexers used are 4:1 demultiplexers. The demultiplexers translate the 4 bit video binary words into a single FET switch closure for each column. There are preferably 16 possible FET switch connections. Then, as discussed above, lines V1 to V16 are connected to linear amplifiers, each preferably representing a different voltage level. The voltage line V1 through V16 is switched through the selected FET, as determined by the grey scale code.

Figure 5:
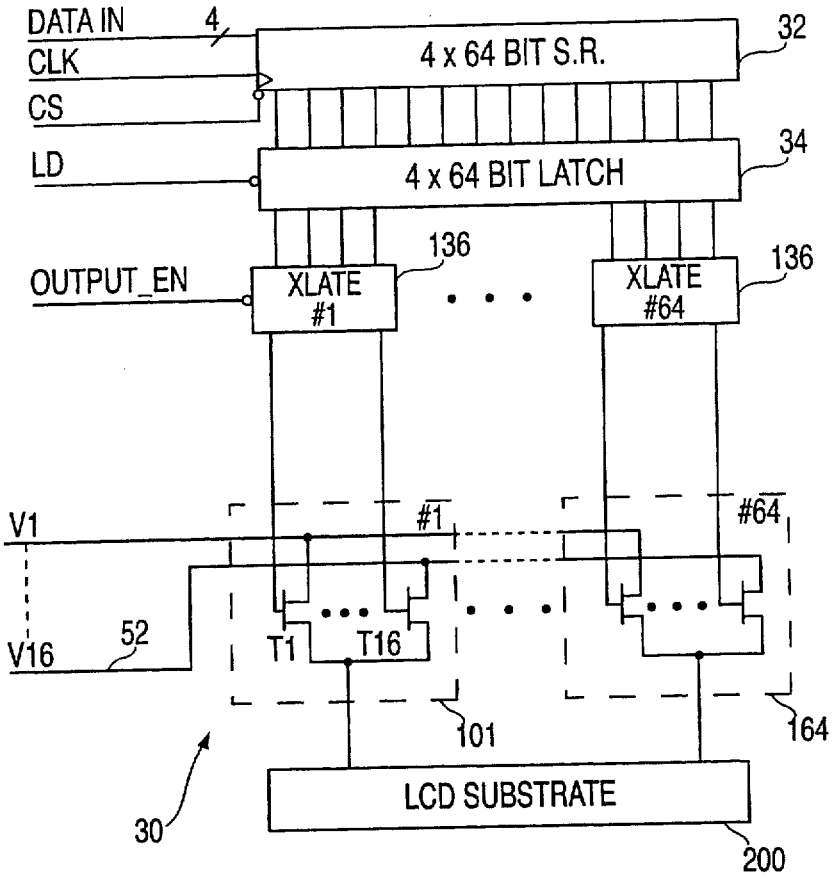
FIG. 5 shows a video interface block diagram incorporating the method of the invention to generate a LCD column drive signal.

Referring now to FIG. 5, an alternative method of the invention is shown. In operation, data is clocked into shift register 32 in serial fashion as in the operation of FIG. 2. Shift register 32 may advantageously be a 64×4 bit device. The shift register produces a single column address for each of the 64 columns. The data is latched and sent through to a plurality of translation devices 136 that receive the data and translate it to a grey code scale. The output of the translators 136 are then sent to a series of switches (T1–T16) that control the LCD substrate 200. Those skilled in the art will appreciate that the latching mechanism can also be implemented as flip-flops. In FIG. 2, the translation devices 136 are shown as demultiplexers 36. As discussed above, lines V1–V16 are connected to each switch (T1–T16), each line preferably representing a different voltage level. The voltage lines are then gated through the switches controlled by the output of the translation devices 136. This accomplishes the grey scale coding by uniquely switching one voltage to the liquid crystal display substrate 200.

As shown in FIG. 4, the voltage along one of the voltage supply lines V1–V16 could be switched by switch 52 to receive an external voltage generated by an external voltage generator 54.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures can be accomplished without departing from the scope of the invention itself.

What is claimed is:

1. A saturating column driver for an LCD substrate comprising:

register means for entering digital data in a serial fashion to produce a single-column address including a video binary word;

means for latching the single-column address connected to the register means;

unclocked means for translating the video binary word into a plurality of grey scale coded bits connected to the latching means;

a plurality of switching means for switching each of said plurality of switching means having an input terminal, an output terminal and a control terminal wherein the control terminal is connected to one of the grey scale coded bits and wherein each output terminal is connected to one column of the LCD substrate; and a plurality of voltage generator means for generating a plurality of electronic signals connected to each input terminal so that when the switching means is activated the voltage generator means supplies one electronic signal through the switching means to drive the LCD substrate.

2. The apparatus of claim 1 wherein the register means comprises a shift register.

3. The apparatus of claim 1 wherein the latching means comprises a digital flip-flop circuit.

4. The apparatus of claim 1 wherein the translating means comprises a demultiplexer.

5. The apparatus of claim 4 wherein the demultiplexer comprises a plurality of 4 to 16 bit demultiplexers.

6. The apparatus of claim 1 wherein the plurality of voltage generator means comprise pre-set voltages.

7. The apparatus of claim 6 wherein the plurality of pre-set voltages are generated through an external voltage connected through a voltage divider string.

8. The apparatus of claim 1 wherein the plurality of voltage generator means vary incrementally in equal increments.

9. The apparatus of claim 1 wherein the plurality of voltage generator means vary in accordance with the dynamics of a video camera.

10. The apparatus of claim 1 wherein the plurality of voltage generator means includes at least 16 pre-set voltage levels.

11. Apparatus for providing grey scale for use in a video interface having a LCD substrate comprising:

(a) a shift register for entering digital data in a serial fashion to produce a single-column address including a video binary word;

(b) a latch connected to the shift register for latching the video binary word;

(c) a demultiplexer for decoding the video binary word into a plurality of grey scale coded bits;

(d) a level shifter for shifting the voltage level of the grey scale coded bits from a logical level to a switching level;

(e) a plurality of switches having an input pole and an output pole connected to the level shifter and responsive to one of each of the grey scale coded bits; and (f) a plurality of preset voltages each connected to the input pole of one of the switches so that when the switch is closed the preset voltage is passed through to the LCD substrate.

12. The apparatus of claim 11 wherein the demultiplexer comprises a plurality of 4 to 16 bit demultiplexers.

13. The apparatus of claim 11 wherein the plurality of pre-set voltages are generated through an external voltage connected through a voltage divider string.

14. The apparatus of claim 11 wherein the plurality of pre-set voltages vary incrementally in equal increments.

15. The apparatus of claim 11 wherein the plurality of pre-set voltages vary in accordance with the dynamics of a video camera.

16. The apparatus of claim 11 wherein the plurality of pre-set voltages includes at least 16 pre-set voltage levels.

17. The apparatus of claim 1 wherein the plurality of switches comprise transistors.

18. The apparatus of claim 11 wherein the plurality of switches comprise transistors.

19. Apparatus for providing grey scale for use in a video interface having a LCD substrate comprising:

(a) a shift register for entering digital data in a serial fashion to produce a single-column address including a video binary word;

(b) a latch connected to the shift register for latching the video binary word;

(c) a demultiplexer for decoding the video binary word into a plurality of grey scale coded bits;

(d) a level shifter for shifting the voltage level of the grey scale coded bits from a logic level to a switching level;

(e) a pluralilty of switches having an input pole and an output pole connected to the level shifter and responsive to one of each of the grey scale coded bits; and (f) a plurality of preset voltages each connected to the source of one of the FETs so that when the FET is turned on the preset voltage is passed through to the LCD substrate, wherein the plurality of preset voltages are generated through an external voltage source comprising a voltage divider string.

20. The apparatus of claim 19 wherein an external generator is connected through a second plurality of switches to the plurality of preset voltages so as to allow signals generated by the external generator to be substituted for any or all of the preset voltages.

* * * * *

UNITED STATES PATENT AND TRADEMARK OFFICE

CERTIFICATE OF CORRECTION

PATENT NO. : 5,061,920

DATED : October 29, 1991

INVENTORS : L. A. Nelson

It is certified that error appears in the above-identified patent and that said Letters Patent is hereby corrected as shown below:

Substitute attached corrected Fig. 2 for Fig. 2 of the printed patent and add the attached Fig. 5

Signed and Sealed this

Fifteenth Day of May, 2001

*Attest:*

*Attesting Officer*

NICHOLAS P. GODICI

*Acting Director of the United States Patent and Trademark Office*